United States Patent [19]

Stokoe et al.

[11] Patent Number: 4,687,887

[45] Date of Patent: Aug. 18, 1987

[54] DUAL IN-LINE PACKAGE SLIDE SWITCH WITH DETENT ASSEMBLY

[75] Inventors: Philip T. Stokoe, N. Attleboro, Mass.; Dennis R. Boulais, Danielson, Conn.

[73] Assignee: Alco Electronic Products, Inc., N. Andover, Mass.

[21] Appl. No.: 817,006

[22] Filed: Jan. 8, 1985

[51] Int. Cl.[4] ..... H01H 15/02

[52] U.S. Cl. ..... 200/16 F; 200/16 D

[58] Field of Search ..... 200/16 C, 16 D, 16 F, 200/1 R, 254, 291

[56] References Cited

U.S. PATENT DOCUMENTS

| | | | |
|---|---|---|---|
| 2,162,895 | 6/1939 | Mastney | 200/16 F |
| 3,271,535 | 9/1966 | Vananzi | 200/16 C |
| 3,485,966 | 12/1969 | Bailey et al. | 200/291 X |
| 3,500,002 | 3/1970 | Bedocs | 200/16 C |
| 3,912,887 | 10/1975 | Gratz et al. | 200/291 X |
| 3,947,391 | 3/1976 | Lutzenberger | 200/291 X |
| 4,075,442 | 2/1978 | Fukuda et al. | 200/16 F |
| 4,324,958 | 4/1982 | Valleau | 200/16 F |

*Primary Examiner*—J. R. Scott

*Attorney, Agent, or Firm*—Pearson & Pearson

[57] ABSTRACT

A dual-in-line switch package includes a base, a slider, and a cover. The base comprises the in-line-terminals and on its upper part the corresponding contact pins. The slider contains at least one contact having teeth to contact the pins. A handle is used for moving the slider to its different positions. The cover has an opening for access to the upwardly extending handle. The base has a projecting detent on its upper surface. The slider has located on its bottom surface a pair of detent receiving recesses. The detent and recesses comprise a detent assembly which retain the slider in one of two operative positions.

5 Claims, 12 Drawing Figures

DUAL IN-LINE PACKAGE SLIDE SWITCH WITH DETENT ASSEMBLY

FIELD OF THE INVENTION

The invention relates to miniature slide switches of a DIP configuration.

BACKGROUND OF THE INVENTION

The DIP configuration is prevalent in many electronic applications and slide switches of this configuration are known. For example, U.S. Pat. No. 4,075,442 issued Feb. 21, 1978 to Fukuda, et al for Miniature Slide Switch Assembly Having Flexible Detent on Movable Actuator or Fixed Housing, discloses a slide switch having a base member in which a slide member of the switch reciprocates. The base is furnished with recesses in above on the surface of the base member and a matching projection on the slide. A detent action then takes place between the projection and the semicircular recesses in operation to fix the position of the slide in accordance with the desired switch connections. The recesses are off center and are located to the side of the base.

Other patents relating to DIP switches are, for example, U.S. Pat. No. 4,119,823 to Matsueda, et al, Oct. 10, 1978 for an Electrical Switch which shows individual switch settings for individual pairs of terminals. U.S. Pat. No. 4,168,404 to Lockard Sept. 18, 1979 for Impedance Programming DIP Switch Assembly also allows individual switching of pairs of terminals in a DIP switching arrangement. U.S. Pat. No. 4,332,987 to Hoffman for a DIP Switch shows a slide body means in a DIP switch which is receivable in and movable along a channel. U.S. Pat. No. 4,352,966 to English, et al, Oct. 5, 1982 for a Slide Switch discloses a base with a bearing surface. A slider has switch arms which are deformably biased freely over confronting cam surface of contacting projections extending from a housing. U.S. Pat. No. 4,376,234 to Liagaud, Mar. 8, 1983 for a DIP Switch shows a base, pairs of legs from the base, and slide contacts for each pair of legs.

SUMMARY OF THE INVENTION

According to the invention, the slide switch comprises a base from which extend downwardly a series of terminals in two parallel rows in DIP configuration. Contact pins extend upwardly from the base in two parallel longitudinally extending rows and serve as connections to the terminals. A slider longitudinally slidable in the direction of the rows has downwardly extending contacts selectively to mate with and make bridging electrical connections with some of the contact pins upwardly extending from the base in correspondence to the longitudinal position of the slider. The slider has means on its upper surface for imparting sliding motion to the slider in a longitudinal direction. A cover extends over the base, captures the slider between the cover and the base, and restrains the slider to longitudinal motion. The cover has an aperture to afford access to the slider moving means.

The base has on its upper surface a detent, and the slider has on its lower surface a pair of detent receiving recesses, the detent being complementary to each of one of the two detent receiving recesses for maintaining the slider firmly in one of two selected positions to which the detent is held in operative detent relation by the cover pressing on the slider.

BRIEF DESCRIPTION OF THE DRAWINGS

The various objects, advantages, and novel features of the invention will be more fully understood from the following detailed description of an embodiment of the invention when read in connection with the accompanying drawing in which like reference numerals refer to like parts, and in which.

DESCRIPTION OF A PREFERRED EMBODIMENT

Figure 1:
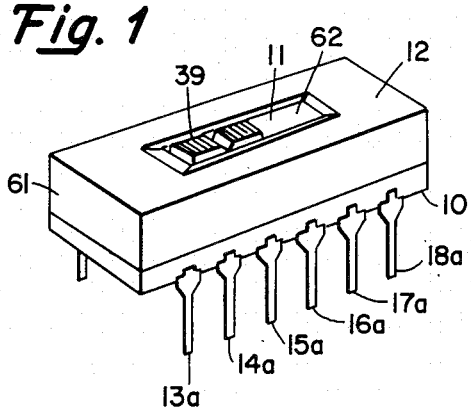
FIG. 1 is a perspective view of an embodiment of the invention.

Referring to FIG. 1, a slide switch embodying the invention comprises a base 10, a slider 11, and a cover 12. Terminals 13*a* through 18*a* are paired respectively with terminals 13*b* through 18*b*, and extend downwardly from the base 10 in a dual in-line configuration (only one "a" contact of each pair is visible in FIG. 1.

Figure 2:
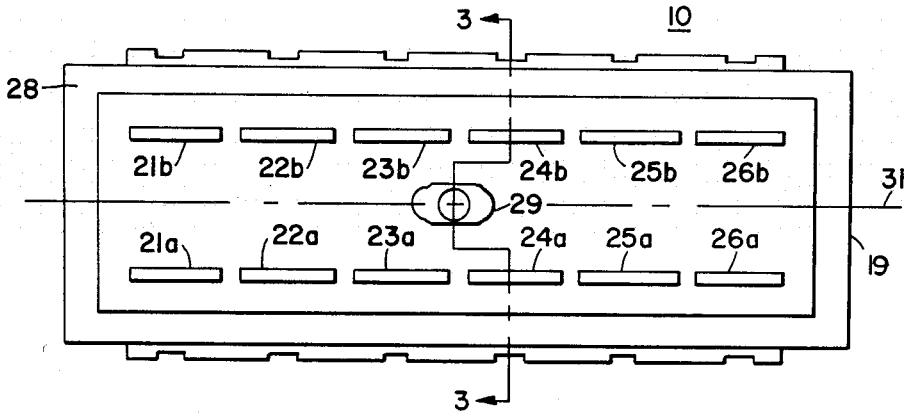
FIG. 2 is a top view of the embodiment of FIG. 1 with the cover and slider removed, showing the base.
Figure 3:
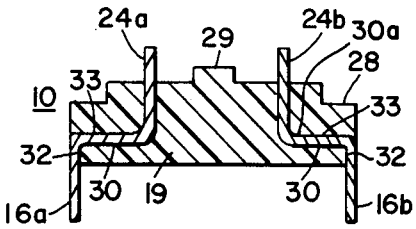
FIG. 3 is a sectional view of the base of FIG. 2 taken along the lines 3—3 of FIG. 2.
Figure 4:
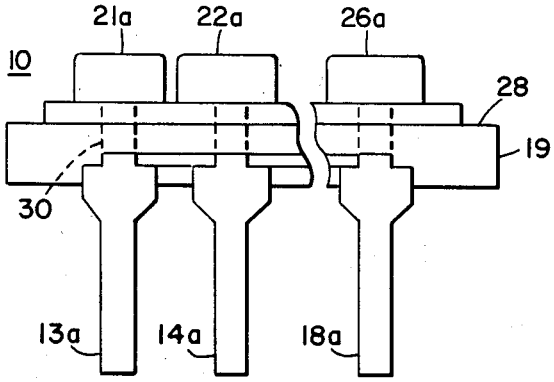
FIG. 4 is a partial side view of the base of FIG. 2.

Referring to FIGS. 2, 3, and 4, each terminal such as 16*a*, 16*b* extend through a base floor 19 of the base 10 and then upwards from the upper surface of base floor 19 to form respectively contact pins 21*a* through 26*a* which are paired respectively with contact pins 21*b* through 26*b* (see FIG. 2). A peripheral ledge 28 (FIGS. 2, 3, and 4) surround the upper part of base floor 19. A detent 29 is raised on the central upper surface of base floor 19 symmetrically along a median longitudinal line 31. The detent 29 which may be an embossment, is also symmetrical with respect to a transverse central line (not shown). A continuous connection 30*a* interconnects respective contacts 21*a*–26*a* and 21*b*–26*b* respectively through internal passageways 30, with respective contacts 13*a*–16*a*, and 13*b*–16*b*. Vertical grooves 32 along the side of the base floor 19 permit the bending in closely to the base member of the contacts as 16*a* of FIG. 3 as they emerge from the base floor 19, permitting the intermediate part of terminals 33 to lay flat without obtruding from the base member horizontally. The contact pins 21*a* through 26*a*, and 21*b* through 26*b*, all extend vertically to the same height above the base floor 19.

Referring to FIGS. 5 through 8, the slider 11 comprises a slider element 35 having a bottom 34 with two elongated passageways 40 and 52, and a generally rectangular bore 38 in the bottom 34 of slider element 35, which surrounds a pair of detent receiving recesses 36 and 37. Each recess 36, 37 is complementary in form to the detent 29 on the base 10. The base member has an upwardly extending handle or means of movement 39. Apertures 41, 42 are formed in the slider element 35, one on each side of the longitudinal axis of symmetry and allow a punch to pass through and stamp out the connection link. In rectangular apertures 44, 45, 46, and 47 (44 and 45 being on one side of the axis 31 in FIGS. 5 and 6, and 46 and 47 being on the other side) are downwardly extending contacts 48 through 51 respectively.

Figure 5:
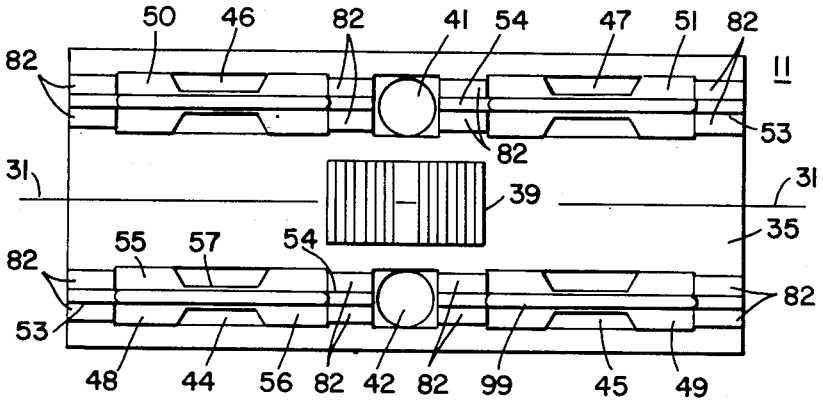
FIG. 5 is a top view of the slider of FIG. 1, with the top removed.
Figure 6:
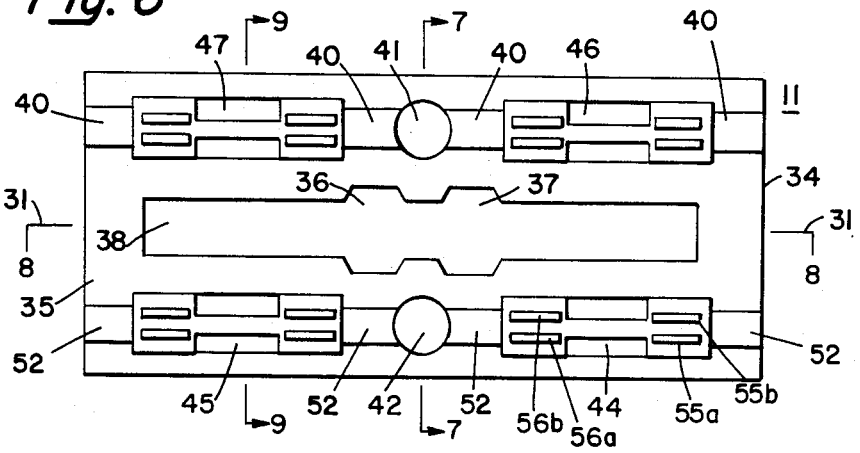
FIG. 6 is a bottom view of the slider of FIG. 5.

Only downwardly extending contact 48 need be described as the others are similar and arranged in their respective apertures in a similar manner, symmetrically longitudinally and transversely. In FIG. 5, contact 48 is a single piece of metal having two horizontally longitudinal extensions 53, 54 and secured in the top of the slider element by pads 82. Two winglike portions 55,56 of contact 48, adjoin the extensions 53 and 54 respectively, and these winglike portions in turn are connected to the top of a bridging portion 57. The winglike portions 55 and 56 at their sides are bent downwards at the margins of the rectangular aperture 44. Thus, in FIG. 6 the winglike portion 55 finally terminates in a pair of teeth contacts 55*a* and 55*b*, and the winglike portion 56 finally terminates in a pair of teeth contacts 56*a* and 56*b*.

Figure 7:
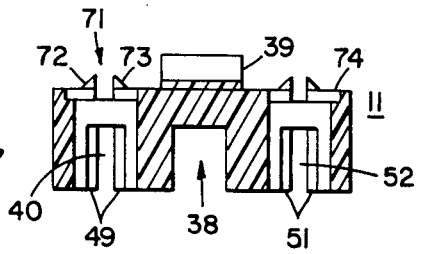
FIG. 7 is a sectional view taken along the lines 7—7 of FIG. 6.
Figure 8:
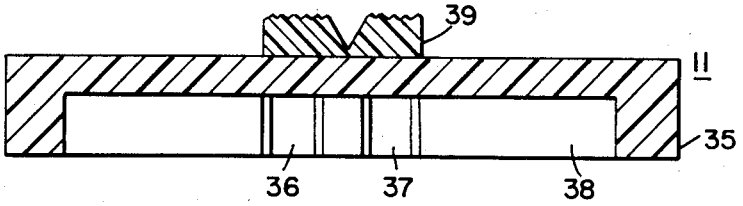
FIG. 8 is a sectional view along the lines 8—8 of FIG. 6.
Figure 10:
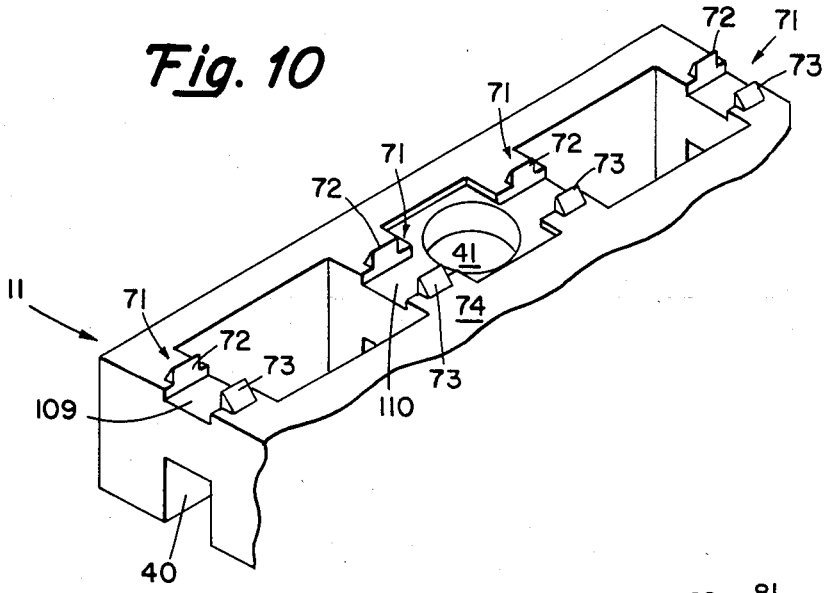
FIG. 10 is an enlarged partial side perspective view showing the deformable hold down tabs.

FIGS. 7 and 10 also shows a pair 71 of deformable hold down tabs 72 and 73 on the surface 74 of the slider which are deformed by ultrasonic thermal displacement to hold the ends 103 and 104 of the contacts in the recesses 109 and 110 so that there is no pitch or sidewise movement of the contact which is independently suspended and captured in the slider recess and slot. After deformation the tabs become pairs 81 of support pads 82 which also support the cover.

The cover 12 comprises an inverted box-like portion 61, open at the bottom which fits down over the assembly of slider 11 and base 10, so that the bottom margin of inverted box-like portion 61 rests on the ledge 28, and may be then ultrasonically welded to the peripheral ledge. A rectangular aperture 62 on the top 61, is open to access handle 39. The inner sidewalls of the box-like portion 61 enclose closely the slider to permit the slider to be held in slidable longitudinal motion only in either recess, the top of the box-like portion 61 preventing upward movement of the slider 11 and by the cover acting against the slider.

In FIG. 10 there is a plurality of deformable hold-down tabs 72 and 73 before deformation and before the contacts have been included in their appropriate recesses.

Figure 11:
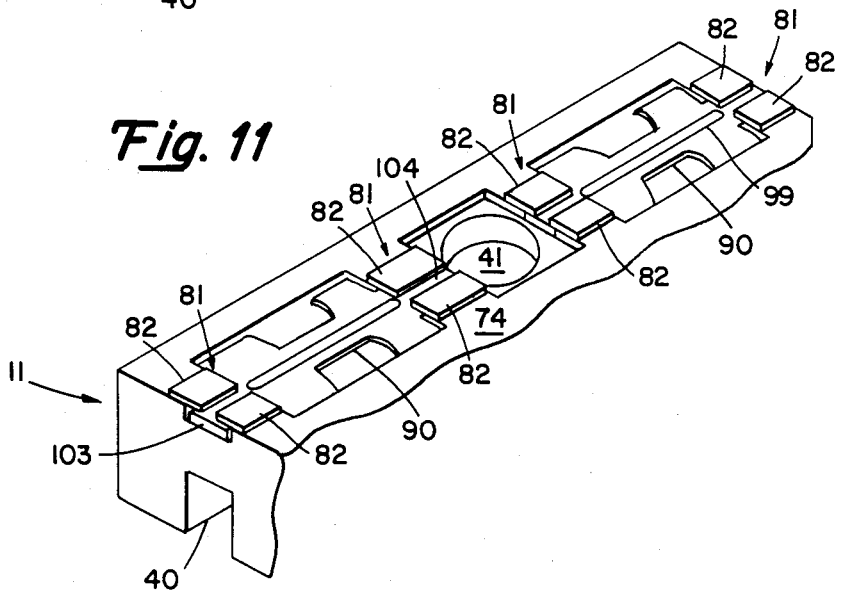
FIG. 11 is an enlarged partial side perspective view showing the support pads.

In FIG. 11 there are numerous pairs of pads 81 of support pads 82 on the surface 74 of the slider which may support the cover.

Figure 12:
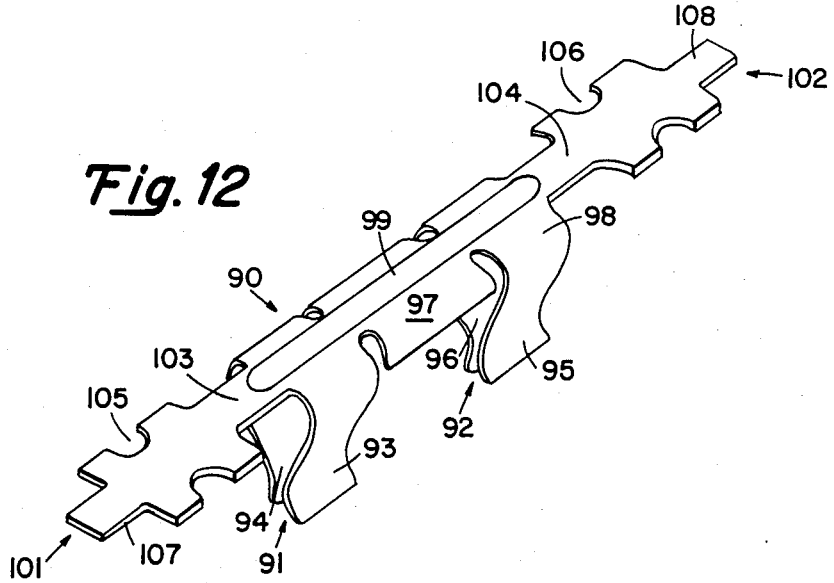
FIG. 12 is an enlarged side perspective view of the inverted U-shaped contact.

FIG. 12 highlights a U-shaped contact 90 which has two pairs 91 and 92 of downwardly extending teeth 93, 94, 95 and 96 which are longitudinally connected to each other by a generally semicircular elongated connector 97.

On the upper surface 98 of the contact 90, is an elongated rib 99 which strengthens the contact. At each opposite end 101 and 102 of the contact which is sheared off before it is placed in the slide there is a generally flat square end 103 and 104 connected to a rectangular member 107 and 108 which protrudes therefrom and has a semicircular recess 105 and 106 which act to seat the contact during the manufacturing process on the production line in the slider.

Figure 9:
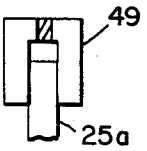
FIG. 9 is a partial sectional view along the lines 9—9 of FIG. 6 with addition of a pin in place.

To assemble the switch the slider 11 is placed on top of the base 10 with the pairs of teeth gripping or engaging the corresponding contact pins, as shown in FIG. 9 with a pin 25*a* grasped. Thus, for example, teeth 55*a* and 55*b* may clasp or engage pin 21*a*. In this position, pin 21*a* is engaged between teeth 55*a* and 55*b*, and pin 22*a* is engaged between teeth 56*a* and 56*b*. In this fashion the teeth of downwardly extending contact 49 clasp the pins 24*a* and 25*a*. In this initial position the teeth of contact 48 engage and short circuit the pins 21*a* and 22*a*, the teeth of contact 49 engage and short circuit the pin 24*a* and 25*a*, the teeth of contact 50 engage and short circuit the pins 24*b* and 25*b*. The top is now put in place and affixed by ultrasonic welding or the like at the ledge 28. When in place, the handle 39 is accessible and the switch slider may be slid to either position. In the other position the teeth of contact 48 engage pins 22*a* and 23*a*, the teeth of contact 49 engage pins 25*a* and 26*a*, the teeth of contact 50 engage the pins 22*b* and 23*b*, and the teeth of contact 51 engage the contact pins 25*b* and 26*b*. As the contact 48, 49, 50 and 51 are each respectively, a single conductor, the effect is to bridge and short-circuit, as noted above, the pins engaged by the teeth of any contact at any time. The initial position, of course, may be that described for the second position of the slider described above. In each of the selected positions a detent action is secured by the cooperation of the base detent and one of the slider recesses, the slider being held down by the cover or top 12.

Briefly, electrically we have a slide switch which either short-circuits contacts 13*a* to 14*a*, 16*a* to 17*a*, 13*b* to 14*b*, and 16*b* to 17*b* in one switch position, or in the other switch position short-circuits contacts 14*a* to 15*a*, 17*a* to 18*a*, 14*b* and 15*b*, and 17*b* to 18*b*.

The description herein uses up and down, top and bottom, solely for ease of description. It will be understood that orientation of the switch is not significant.

The slide switch described has the merit of avoiding any torque in its detent action with respect to a longitudinal vertical plane of symmetry, such torque being inherent in the Fukuda detent which is constructed to act on one side of the slide of the slide switch. Applicant's detent is slight and the complementary or matching recesses in the slider provided herein is sufficient to give the desired detent action. Even though the top bears lightly against the slider, there is sufficient natural resilience of the material to allow the detent action to occur. Moreover, the symmetry and simplicity of the arrangement of the present invention leads to an easy and simple manufacturing process.

We claim:

1. An electrical switch comprising:

a base having pairs of electrical terminals extending downwardly from the base in a dual in-line package configuration in two parallel longitudinal rows and contact pins connecting to the terminals extending upwardly from the base in two parallel longitudinally extending rows;

a slider longitudinally slidable in the direction of the rows and having at least one generally rectangular and vertical aperture to receive at least one contact having a plurality of laterally spaced downwardly extending contact teeth selectively to mate with and make bridging electrical connection with some of the pins upwardly extending from the base in correspondence to the longitudinal position of the slider relative to the base, the slider having on its upper surface a means for imparting sliding motion to the slider in the longitudinal direction;

the slider having at least one recess adjacent to the generally rectangular and vertical aperture to receive an end of the downwardly extending contact teeth;

a cover extending over the base and capturing the slider between the cover and the base, the cover having longitudinal aperture on the upper part of the cover to afford access to the sliding motion imparting means; and the base having on its upper surface a detent, and the slider having on its bottom surface a pair of detent receiving recesses, the detent and each recess of the pair being complementary for maintaining the slider firmly in one of two selected positions.

2. An electrical switch according to claim 1 wherein: the slider has a plurality of support pads on the upper surface of the slider to contain the ends of the contact in their respective recesses and support the cover.

3. An electrical switch according to claim 1 wherein: the detent of the base and the recesses of the slider being located centrally with respect to a longitudinal center line between the upwardly extending pins of the base.

4. An electrical switch according to claim 3 wherein: the detent of the base being an embossment which is complementary to the recesses.

5. An electrical switch according to claim 4 wherein: each recess being located symmetrically on either side of a center line transverse to the longitudinal center line of the slider.

* * * * *